United States Patent [19]

Ehlert

[11] Patent Number: 4,874,038

[45] Date of Patent: Oct. 17, 1989

[54] ECONOMICAL HOUSE AIR COOLING ARRANGEMENT

[76] Inventor: George E. Ehlert, 1111 Wadsworth Avenue, North Chicago, Ill. 60064

[21] Appl. No.: 309,866

[22] Filed: Feb. 14, 1989

[51] Int. Cl.[4] ..... F25B 29/00; F25D 23/12

[52] U.S. Cl. ..... 165/48.1; 62/259.1

[58] Field of Search ..... 62/259.1, 262, 263; 165/48.1; 98/38.9

[56] References Cited

U.S. PATENT DOCUMENTS

| | | | |
|---|---|---|---|
| 2,130,606 | 9/1938 | Wanamaker | 165/48.1 X |
| 2,141,855 | 12/1938 | Dodge | 165/48.1 X |
| 2,178,176 | 10/1939 | Lamm | 165/48.1 X |
| 2,702,994 | 3/1955 | Borgerd | 62/263 |
| 2,724,578 | 11/1955 | Swank | 62/259.1 X |
| 2,804,816 | 9/1957 | Hoyer | 62/258.1 X |
| 3,951,205 | 4/1976 | Zilbermann | 98/38.9 X |
| 4,598,558 | 7/1986 | Bingham | 62/263 X |

*Primary Examiner*—William E. Tapolcai

*Attorney, Agent, or Firm*—Richard W. Carpenter

[57] ABSTRACT

An economical air cooling and dehumidifying arrangement for a house wherein a conventional window mountable air cooling and dehumidifying unit cool air discharge opening is connected directly to the air return system of a conventional house forced hot air heating system near the furnace, so the furnace blower can be used to transfer air to the house through the furnace air delivery system.

4 Claims, 2 Drawing Sheets

ECONOMICAL HOUSE AIR COOLING ARRANGEMENT

BACKGROUND OF THE INVENTION

1. Field of the Invention

This invention relates to air conditioning arrangements, and more particularly to an economical air cooling arrangement wherein a conventional window mountable type air cooling and dehumidifying unit is connected directly to the return air system of a conventional forced air heating arrangement, so the blower of the furnace can deliver the cool air to the living rooms of the house through the air delivery system.

2. Description of the Background Art

A background art search directed to the subject matter of this application was conducted in the U.S. Patent and Trademark Office and disclosed the following U.S. Pat. Nos.: 2,682,757, 2,702,994, 2,724,578, 2,804,816, 2,960,924, 3,225,561.

None of the patents uncovered in the search discloses an air cooling arrangement for a house wherein the cool air discharge opening of a conventional window mountable type air cooling and dehumidifying unit is connected by a conduit directly to the air return system, so the furnace blower can deliver cool air to the house through the air delivery system.

SUMMARY OF THE INVENTION

It is an object of the present invention to provide an economical air cooling and dehumidifying arrangement for a house that requires only a conventional window mountable type cooling and dehumidifying unit which is connected to the furnace of a conventional forced air heating system.

A more specific object of the invention is the provision of an arrangement of the type described wherein the cool air discharge opening of a conventional window mountable type air cooling and dehumidifying unit is connected by a conduit directly to the air return system adjacent the furnace, so the blower of the furnace can deliver the cool air to the house through the furnace air delivery system.

These and other objects of the invention will be apparent from an examination of the following description and drawings.

It will be understood that, for purposes of clarity, certain elements may be intentionally omitted from certain views where they are believed to be illustrated to better advantage in other views.

DESCRIPTION OF THE PREFERRED EMBODIMENT

Figure 1:
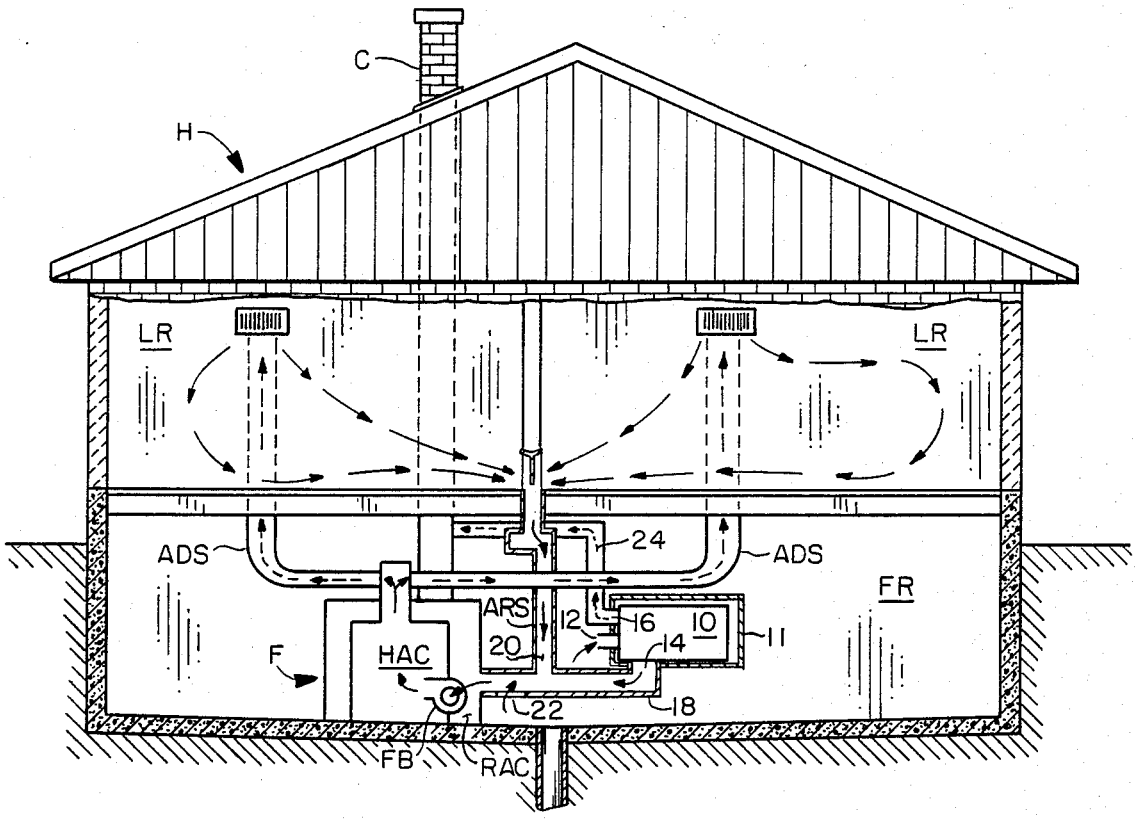
FIG. 1 is a fragmentary diagramatic view of a house embodying the air cooling and dehumidifying arrangement of the present invention, as shown in side elevation.

Turning now to the drawings for a better understanding of the invention, and particularly to FIG. 1, there is illustrated a house H having a living area comprising a plurality of rooms, each indicated at LR, and a furnace room in the basement, indicated at FR. A chimney C extends through the house from the furnace room FR. The rooms are heated by a conventional forced air heating system that includes a furnace F located in the furnace room FR and having a hot air chamber HAC surrounded by a return air chamber RAC. Hot air is delivered from the hot air chamber of the furnace to the rooms LR of the house through a plurality of ducts or conduits referred to hereinafter as the air delivery duct system, ADS. Air is returned to the furnace through another series of ducts or conduits, hereinafter referred to as the air return system, ARS.

Normally, in the winter, as cold air is returned through the air return system ARS to the return air chamber RAC of furnace F, it is forced into the hot air or heating chamber HAC where it is reheated and then forced by the furnace blower FB back out of the furnace through the air delivery system ADS into the living rooms of the house.

The ducts of both the air delivery and air return systems may have vents in various rooms of the house, including the furnace room, so air can enter and leave the rooms. Normally, in cold weather hot air enters the room through the air delivery system and after it has cooled it leaves the room through the air return system.

In the arrangement of the present invention this is reversed, with the cool air being delivered from the furnace through the air delivery system, and the warmer air being returned to the furnace through the air return system.

In the present invention, the furnace of a conventional forced air heating system can be used to transfer, to the living rooms of the house, air that has been cooled and dehumidified by a conventional window mountable type air cooling and dehumidifying unit, at least a portion of which is located within the furnace room. It is to be understood that the furnace room can be either in a basement, as illustrated in FIGS. 3 and 4, or in a room at the same level as the living rooms of the house, as illustrated in FIG. 4.

Figure 2:
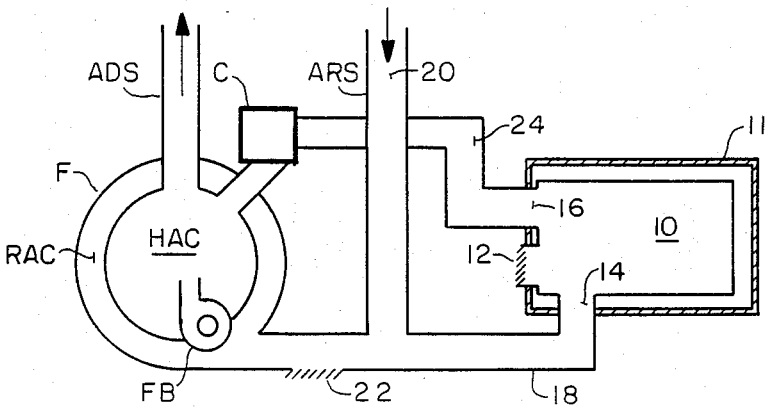
FIG. 2 is a schematic diagram illustrating an air cooling arrangement embodying features of the present invention.
Figure 3:
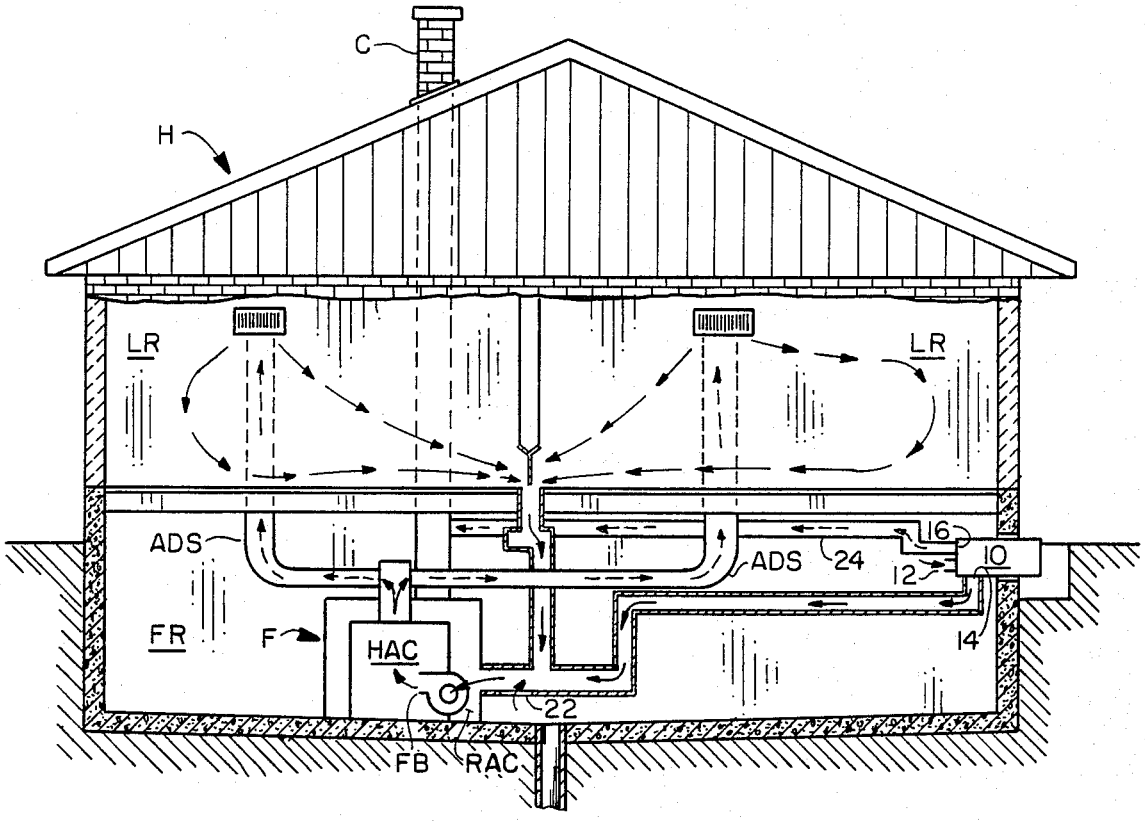
FIGS. 3 and 4 are views similar to that of FIG. 1, but illustrate modified forms of the invention.
Figure 4:
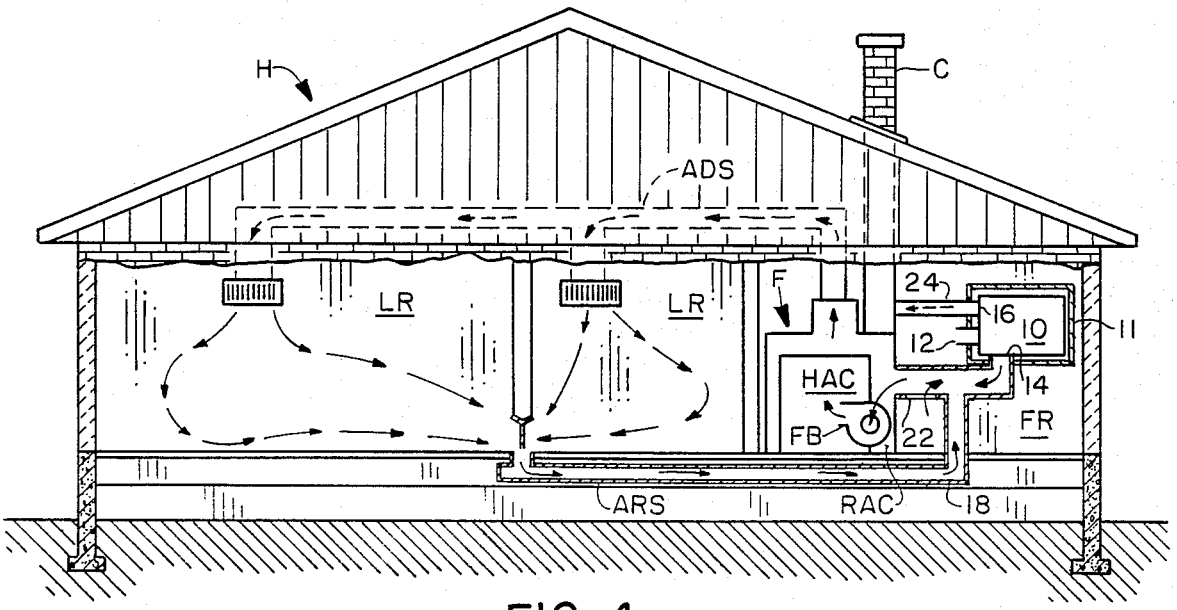

In FIG. 2 there is illustrated the basic concept of the invention which can be applied to the different arrangements illustrated in FIGS. 1, 3, and 4. A conventional air cooling and dehumidifying unit 10, enclosed within a housing 11, is located in the furnace room FR of the house.

The air cooling and dehumidifying unit is of conventional type which is normally mounted in a window. The unit has an air intake opening 12, vented in the furnace room and through which air from the furnace room enters the unit to be recooled and redehumidified.

The unit also has a first discharge opening 14, through which cooled air leaves the unit, and a second discharge opening 16, through which hot air generated in the unit leaves the unit.

An essential feature of the invention is the transmission of cooled air directly from the air cooling unit to the furnace air return system by means of a conduit 18, which extends between the unit cool air discharge opening 14 and a duct 20, which is part of the air return system ARS.

It will be noted that the duct 20 has a vent 22 opening into the furnace room. Vent 22 is located between the furnace and the junction of ARS duct 20 and cooling unit conduit 18, so that as the furnace blower draws air from the house through the air return system, it can also pull freshly cooled air from the unit, as well as previously cooled air from the furnace room, into the furnace for recirculation through the air delivery system.

The cool air in the furnace return air chamber RAC is then forced, by the furnace blower, from the furnace return air chamber through the hot air chamber HAC and up into the living rooms of the house through the air delivery system.

Although not shown and as previously mentioned, both the air delivery and air return system ducts may include vents in the furnace room, so the furnace room can also be cooled.

It will be noted that the hot air discharge opening 16 of the cooling unit 10 is connected directly by means of a duct 24 to the chimney C, so that hot air can be vented directly out of the house from the cooling unit through the chimney.

Turning now to FIG. 3 of the drawings, it will be seen that another form of the invention is shown. In this embodiment all of the parts and elements that correspond to those of the previously described embodiment have been indicated by similar numerals.

In this embodiment, the basic invention is the same, except that the cooling and dehumidifying unit 10 is mounted in a window, with one portion in the furnace room and another portion extending outside of the house. It is still connected directly by a conduit 18 to a duct 20 which forms part of the air return system and is connected to the furnace. In this case the air intake opening 12 of the cooling unit is positioned within the furnace room, so that it takes in air from the furnace room which has been previously cooled and dehumidified.

Also, in this arrangement the cooling unit hot air discharge opening 16 is located outside the house, so the hot air can pass directly into the outer atmosphere.

This arrangement represents a substantial improvement over the arrangement in prior U.S. Pat. No. 2,724,578, issued to H. C. Swank. In the Swank arrangement an air cooling unit is merely mounted in a furnace room window without any direct attachment to the furnace or air return system. In the Swank arrangement, it is intended that cooled air from the unit will enter the furnace room and eventually find its way into the furnace air return system through a vent and then pass into the furnace.

In a forced air heating (cooling) system of the type of both Swank and the present invention there is about a ten degree differential between the temperature of the air leaving the furnace and that of the air in the rooms to be heated. This is due to the gain of heat in the transmission of air from the furnace to the living rooms.

Thus, in order for Swank to have an average temperature of 70 degrees in the living rooms, the furnace room would have to be maintained at a level of approximately 60 degrees. It would be highly inefficient to have to maintain an entire furnace room, especially a large furnace room, at a temperature ten degrees less than the other room of the house. It would not only be an expensive waste of energy, but if the furnace room also happened to be a recreational room, the discomfort would make the arrangement unacceptable.

This would not be a problem with the present invention, because, with the unit cool air discharge open connected directly to the air return system, the furnace room could be maintained at substantially the same level as that of the living rooms.

Turning now to FIG. 4 of the drawings, it will be seen that a slightly modified form of the invention is shown. In this embodiment of the invention, the furnace room FR is located adjacent one of the living rooms LR of a house without a basement, but the basic arrangement for connecting the unit cool air discharge opening to the forced air return system of the furnace is the same as that of the previous embodiments.

Thus, it will be appreciated that the invention provides a novel, but still economical way to cool and dehumidify the air of a house with a conventional window mountable type cooling and dehumidifying unit that is connected directly to the furnace air return system and utilizes the air transfer system of a conventional forced air heating system, including the blower mechanism of a conventional furnace.

What is claimed is:

1. An economical air cooling arrangement for installation in a house having living rooms, a furnace room separate from the living rooms, and a conventional forced air heating system that includes a furnace located in the furnace room and having hot air and cold air chambers, an air delivery system connected to the furnace hot air chamber for delivering air from the furnace to the living rooms in the house, an air return system connected to the furnace cold air chamber for returning air from the living rooms to the furnace, and a blower in the furnace for forcing air from the air return system through the furnace into the air delivery system, said arrangement comprising:

(a) a conventional window mountable type of air cooling and dehumidifying unit, at least a portion of which is located in the furnace room, and which has an air intake opening and separate cool air and warm air discharge openings;

(b) means connecting said unit cool air discharge opening directly to a return duct of the air return system;

(c) said return duct having an air intake opening located in the furnace room between the furnace and said means connecting said unit cool air discharge opening to the air return system;

(d) means for venting warm air from said unit warm air discharge opening out of the house comprising a conduit extending from said warm air discharge opening to a chimney of the house;

(e) means for venting air from the furnace room into said unit air intake opening.

2. An economical air cooling arrangement for installation in a house having living rooms, a furnace room separate from the living rooms, a chimney extending to the outside of the house from the furnace room, and a conventional forced air heating system that includes a furnace located in the furnace room and having hot air and cold air chambers, an air delivery system connected to the furnace hot air chamber for delivering air from the furnace to the living rooms in the house, an air return system connected to the furnace cold air chamber for returning air from the living rooms to the furnace, and a blower in the furnace for forcing air from the air return system through the furnace into the air delivery system, said arrangement comprising:

(a) a conventional window mountable type of air cooling and dehumidifying unit located in the furnace room, and which has an air intake opening and separate cool air and warm air discharge openings;

(b) means connecting said unit cool air discharge opening directly to a return duct of the air return system;

(c) said return duct having an air intake opening located in the furnace room between the furnace and said means connecting said unit cool air discharge opening to the air return system;

(d) means connecting said unit warm air discharge opening to said chimney;

(e) means for venting air from the furnace room into said unit air intake opening.

3. An arrangement according to claim 2, wherein said means connecting said unit cool air discharge opening directly to the air return system comprises a conduit extending between said unit cool air discharge opening and said return duct.

4. An arrangement according to claim 2, wherein said means for venting warm air out of the house from said unit warm air discharge opening comprises conduit extending from said warm air discharge opening to the chimney of the house.

* * * * *